US008566967B2

(12) United States Patent
Janisse et al.

(10) Patent No.: US 8,566,967 B2
(45) Date of Patent: Oct. 29, 2013

(54) HELMET WITH NECK ROLL

(75) Inventors: Richard J. Janisse, Windsor (CA); Dale W. Kohler, Metamora, MI (US)

(73) Assignee: Warrior Sports, Inc., Warren, MI (US)

( * ) Notice: Subject to any disclaimer, the term of this patent is extended or adjusted under 35 U.S.C. 154(b) by 257 days.

(21) Appl. No.: 13/111,146

(22) Filed: May 19, 2011

(65) Prior Publication Data

US 2012/0291183 A1 Nov. 22, 2012

(51) Int. Cl.
*A42B 3/10* (2006.01)

(52) U.S. Cl.
USPC ..... 2/411

(58) Field of Classification Search
USPC ..... 2/467, 209.13, 916, 468, 455, 425, 411; 602/18
See application file for complete search history.

(56) References Cited

U.S. PATENT DOCUMENTS

| | | | | |
|---|---|---|---|---|
| 3,017,639 | A | | 1/1962 | Foley |
| 3,134,106 | A | | 5/1964 | Shaffer et al. |
| 3,497,872 | A | | 3/1970 | Mitchell |
| 3,514,784 | A | | 6/1970 | McDavid |
| 3,609,763 | A | * | 10/1971 | Raney ..... 2/415 |
| 3,657,739 | A | | 4/1972 | Holmes, Sr. |
| 3,671,974 | A | | 6/1972 | Sims |
| 3,765,029 | A | | 10/1973 | Germain |
| 3,818,509 | A | | 6/1974 | Romo et al. |
| 3,855,631 | A | | 12/1974 | Ettinger |
| 3,873,996 | A | | 4/1975 | Varteressian |
| 3,900,896 | A | | 8/1975 | Ackerman |
| 3,981,027 | A | | 9/1976 | Anderson |
| 4,135,252 | A | | 1/1979 | Latina et al. |
| 4,158,242 | A | | 6/1979 | Mitchell |
| 4,219,193 | A | | 8/1980 | Newman |
| 4,319,362 | A | | 3/1982 | Ettinger |
| 4,501,023 | A | | 2/1985 | Bilberry |
| 4,638,510 | A | | 1/1987 | Hubbard |
| 4,821,339 | A | | 4/1989 | Fair |
| 4,870,705 | A | | 10/1989 | Higby et al. |
| 4,881,529 | A | | 11/1989 | Santos |
| 4,989,265 | A | | 2/1991 | Santos |
| 4,996,720 | A | | 3/1991 | Fair |
| 5,121,507 | A | | 6/1992 | Brown |
| D329,508 | S | | 9/1992 | Fair |
| 5,261,125 | A | | 11/1993 | Cartwright et al. |
| 5,272,770 | A | | 12/1993 | Allen et al. |
| 5,287,562 | A | | 2/1994 | Rush, III |
| 5,353,437 | A | | 10/1994 | Field et al. |
| 5,390,367 | A | | 2/1995 | Rush, III |
| 5,404,590 | A | | 4/1995 | Monica, Jr. |
| 5,437,613 | A | | 8/1995 | Reggio et al. |
| 5,483,698 | A | | 1/1996 | Douglas, Jr. |
| 5,493,736 | A | | 2/1996 | Allison |

(Continued)

*Primary Examiner* — Khoa Huynh
*Assistant Examiner* — Anna Kinsaul
(74) *Attorney, Agent, or Firm* — Warner Norcross & Judd LLP

(57) ABSTRACT

A helmet includes an outer shell, a liner and a neck roll. The neck roll is configured to absorb impact between the helmet and a wearer's head/neck when the wearer's head is forced rearward. The neck roll can be positioned adjacent a lower rim of the liner and can include one or more deformable impact absorption compartments to absorb the impact between the helmet and the wearer's head/neck. The impact absorption compartments can be formed by a base, two generally upwardly extending walls and one or more generally upwardly extending support members extending between the upwardly extending walls. The impact absorption characteristics of the compartments can be varied to provide a desired level of impact absorption.

24 Claims, 5 Drawing Sheets

(56) References Cited

U.S. PATENT DOCUMENTS

| | | | | |
|---|---|---|---|---|
| 5,517,699 | A | 5/1996 | Abraham, II | |
| 5,546,601 | A | 8/1996 | Abeyta | |
| 5,546,609 | A | 8/1996 | Rush, III | |
| 5,581,820 | A | 12/1996 | Cartwright et al. | |
| 5,652,959 | A | 8/1997 | Proctor | |
| 5,771,493 | A | 6/1998 | Proctor | |
| 5,862,523 | A | 1/1999 | Proctor | |
| 5,956,777 | A | 9/1999 | Popovich | |
| 6,052,835 | A | 4/2000 | O'Shea | |
| 6,058,517 | A | 5/2000 | Hartunian | |
| 6,067,665 | A | 5/2000 | DePalma et al. | |
| 6,125,851 | A | 10/2000 | Walker et al. | |
| 6,385,781 | B1 | 5/2002 | Rose et al. | |
| 6,434,756 | B1 | 8/2002 | Hoop | |
| 6,481,026 | B1 | 11/2002 | McIntosh | |
| 6,499,149 | B2 | 12/2002 | Ashline | |
| 6,532,962 | B1 | 3/2003 | Walker et al. | |
| 6,810,535 | B1 | 11/2004 | Moloney | |
| 6,874,170 | B1 * | 4/2005 | Aaron | 2/468 |
| 6,971,123 | B2 | 12/2005 | Weaver | |
| D522,178 | S | 5/2006 | Ashline | |
| 7,225,477 | B1 | 6/2007 | Rodriguez | |
| 7,661,164 | B2 | 2/2010 | Chen | |
| 7,849,525 | B2 | 12/2010 | Ghajar | |
| 7,861,326 | B2 * | 1/2011 | Harty | 2/468 |
| 2004/0060100 | A1 * | 4/2004 | Reiterman | 2/422 |
| 2005/0246824 | A1 | 11/2005 | Berger et al. | |
| 2006/0248623 | A1 * | 11/2006 | Miller | 2/6.6 |
| 2007/0163032 | A1 | 7/2007 | Kerr | |
| 2009/0064385 | A1 * | 3/2009 | Crossman et al. | 2/6.6 |
| 2009/0126085 | A1 * | 5/2009 | Gale | 2/415 |
| 2010/0192290 | A1 * | 8/2010 | Husain | 2/468 |
| 2011/0099675 | A1 * | 5/2011 | Parks et al. | 2/2.5 |

* cited by examiner

HELMET WITH NECK ROLL

BACKGROUND OF THE INVENTION

The present invention relates to neck rolls for helmets, and more particularly, to neck rolls that are adapted to absorb forces when impacted.

There are a variety of commercially available helmets designed to protect a wearer's head during sporting, recreational and occupational activities. Most protective helmets include a hard outer shell that forms a portion of the helmet designed to be impacted, and a liner adapted to fit between the hard outer shell and the wearer's head.

While the wearer engages in activities, they may experience an impact to the front, sides, or crown of the helmet. This impact can cause the helmet and, consequently, the wearer's head to rotate or snap in a lateral or posterior direction. If the impact is significant, the helmet and wearer's head may be rotated such that the rear edge of the helmet impacts the dorsal/back side of the wearer's head/neck. In this situation, a significant portion of impact to the helmet may be transmitted directly to the neck, spine and/or musculature of the wearer.

Some helmet configurations attempt to address this type of frontal impact and incorporate a cushioning element that cushions the back of the wearer's head and neck during an impact. For example, certain helmets include a continuous, uniform foam pad or "neck roll." These foam pads, however, are only as good as the compressible foam from which they are constructed. Such neck rolls can be in the form of a long cylindrical foam piece that extends around a lower part of the helmet and is interposed between that lower part and the neck, shoulders and/or back of the wearer when the helmet is donned. Further, these continuous, uniform pads usually do not offer an opportunity to easily vary the impact absorption characteristics along a length of the pad, or to vary the impact absorption characteristics between foam pads. Usually, such conventional pads use foam or similar liquid-absorbing materials absorb sweat or other fluids during use. Over time, these pads may develop an undesirable odor that requires the pad to be washed or replaced.

SUMMARY OF THE INVENTION

A helmet including a neck roll is provided to cushion an impact to the helmet.

In one embodiment, the helmet can include a hard outer shell and a liner having an occipital portion terminating at a lower rim of the liner. A neck roll can be positioned adjacent the lower rim and can include a base separated from the lower rim by a preselected distance.

In another embodiment, the neck roll can include one or more support members extending between the base and the lower rim. These support members can separate the neck roll into multiple impact absorption compartments. In this configuration, an impact to the base can cause at least one of the support members to deform and/or compress at least one of the impact absorption compartments to effectively absorb the impact.

In yet another embodiment, the neck roll can include an interior wall and an exterior wall. The interior wall and/or exterior wall can extend a distance greater than the distance between the base and the liner and can be positioned adjacent a respective interior or exterior of the liner. Optionally, the interior wall and/or exterior wall can be releasably or non-releasably attached to the occipital portion of the liner.

In even another embodiment, the distance between certain adjacent support members can be different than the distance between other adjacent support members. Further, the distance between adjacent support members can decrease moving from a central region of the neck roll to one of two outer regions of the neck roll.

In still another embodiment, each support member can be at an angle relative to the base, for example, perpendicular to the base, or at some non-perpendicular angle relative to the base. Optionally, the angle between the support members and the base can vary depending on the location of the support members. As an example, the angles can decrease moving from the central region of the neck roll to the outer regions of the neck roll.

In a further embodiment, the length of at least one support member can be different than the length of another support member. Optionally, the lengths can decrease moving from the central region of the neck roll to the outer regions of the neck roll.

In yet a further embodiment, the thickness of at least one support member can be different than the thickness of another support member. Optionally, the thickness of the support members can increase or decrease moving from the central region to the outer regions of the neck roll.

In still a further embodiment, the volume of at least one impact absorption compartment can be different than the volume of another impact absorption compartment. Optionally, the volume of the impact absorption compartments can decrease moving from the central region to the outer regions of the neck roll.

The helmet and neck roll described herein can absorb at least a portion of the impact between a wearer and the helmet during an impact to the helmet. The configuration of the neck roll can provide the ability to vary the impact absorption characteristics along the length of the neck roll and vary the impact absorption characteristics between different neck rolls. Further, the neck roll can be constructed from a material that does not tend to absorb liquids, perspiration, or other smells, which can limit the development of undesirable odors.

These and other objects, advantages, and features of the invention will be more fully understood and appreciated by reference to the description of the current embodiment and the drawings.

DESCRIPTION OF THE CURRENT EMBODIMENT

I. Overview

Figure 1:
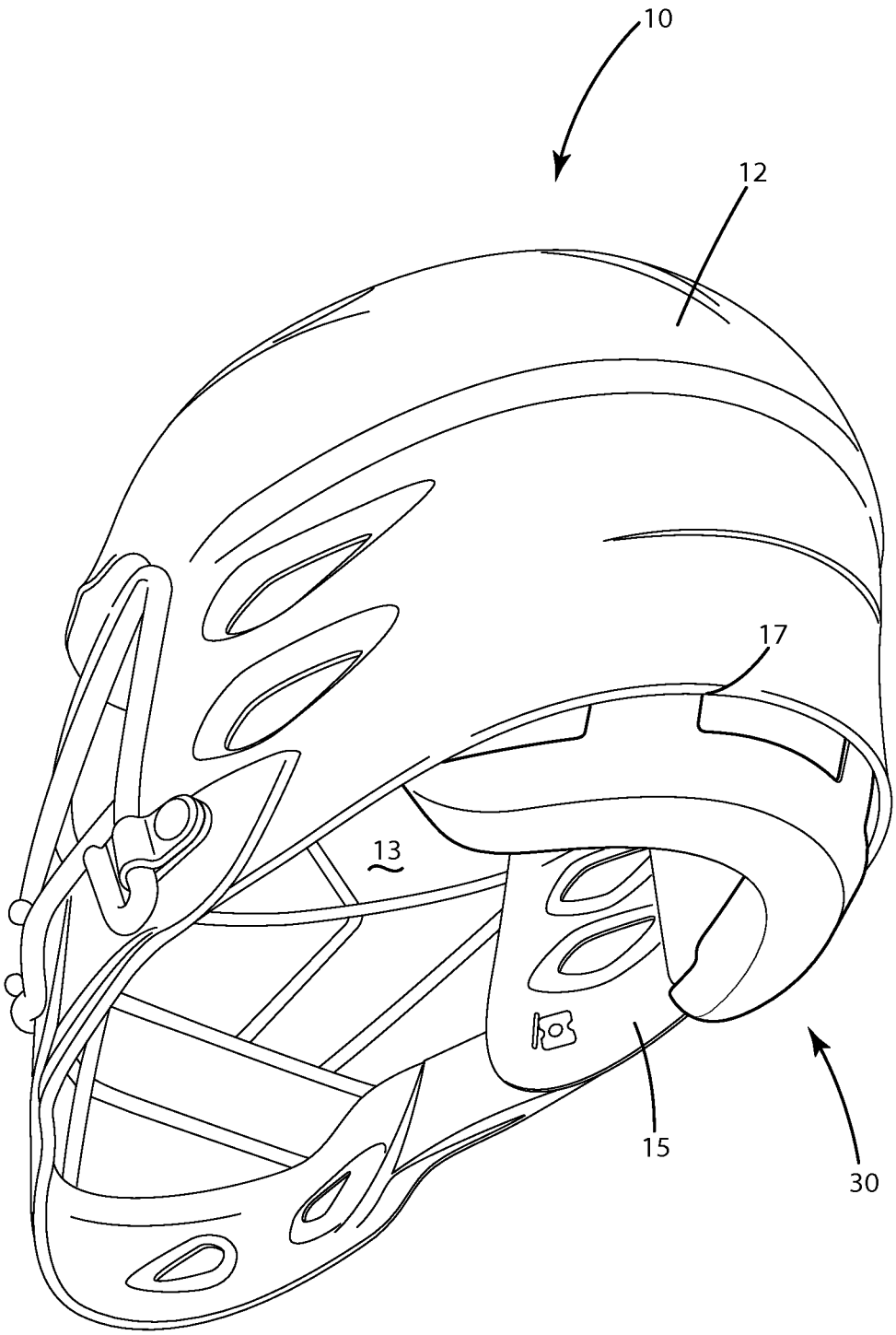
FIG. 1 is a rear perspective view of a helmet of a current embodiment.

A helmet 10 in accordance with a current embodiment is shown in FIGS. 1-8C and generally designated 10. As illustrated there, the helmet is a lacrosse helmet; however, the helmet, neck roll and other features described herein are well suited for virtually any type of helmet. As used herein, "helmet" refers to any headgear designed to be worn on a wearer's head, and includes but is not limited to sporting helmets, such as hockey helmets, lacrosse helmets, football helmets, baseball helmets, equestrian helmets; occupational helmets such as hard hats, riot helmets, military helmets; and recreational helmets, such as climbing helmets, bike helmets, motorcycle helmets, racing helmets, regardless of construction or the materials from which the helmets are made. The helmet 10 can generally include an outer shell 12, a liner 14 and a neck roll 30. The helmet 10 can be configured such that, when the wearer's head is forced sideways and/or rearwards during an impact and the rear edge of the helmet 10 contacts the wearer's back, trapezius, shoulder and/or neck, the neck roll 30 absorbs impact between the helmet and the respective body part.

II. Construction

A helmet 10 in accordance with a current embodiment will now be described in more detail with reference to FIGS. 1-8C. As shown in FIG. 1, the helmet 10 can include an outer shell 12 constructed from a hard or rigid material designed to take an impact and distribute the forces from the impact to a liner 14 located on the interior of the helmet. The outer shell 12 defines an interior 13 and includes an interior surface 15 adapted to face toward the head of a wearer. Suitable materials for the outer shell 12 include, but are not limited to, polycarbonates, nylon, thermoplastics, resins, metals, alloys, carbon fibers, and other materials. The outer shell 12 can be manufactured using any of a variety of suitable processes, including injection molding, thermoforming, and machining. The outer shell 12 can be of a desired aesthetic configuration, and can include a predetermined number of ventilation apertures to provide added comfort by enabling air to circulate around the head of the wearer.

Figure 2:
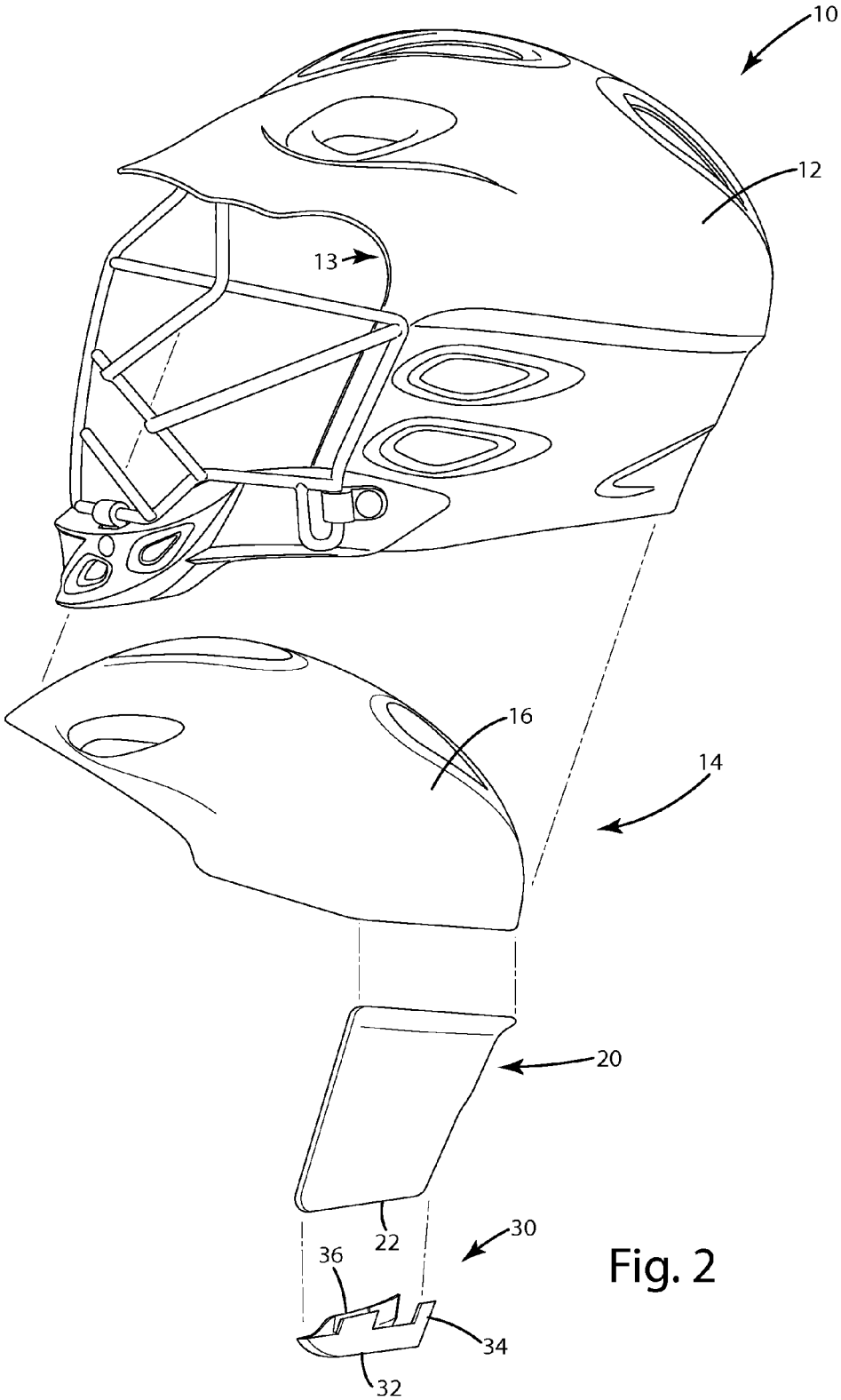
FIG. 2 is a side exploded view of the helmet.

The liner 14 can be located substantially within the interior 13, generally adjacent the interior surface 15 of the outer shell 12. The liner can include a crown portion 16 and an occipital portion 20, as shown in FIG. 2. The crown portion 16 can be adapted to be positioned adjacent the crown of a wearer's head, and the occipital portion 20 can be adapted to be positioned adjacent the occipital region of the wearer's head. Optionally, the crown portion 16 can be connected to the occipital portion 20. If connected, the connection can be any of a number of known connection methods, including rigid, flexible and hinged connections. If unconnected, the crown portion 16 can be positioned adjacent the occipital portion 20 or, optionally, can be positioned at a distance from the occipital portion 20. Although shown as a two piece liner, the liner 14 optionally can include multiple liner pieces, which can be rigidly and/or flexibly coupled to one another. Optionally, the occipital portion can be integral with the crown portion or other portions of the helmet.

Figure 3:
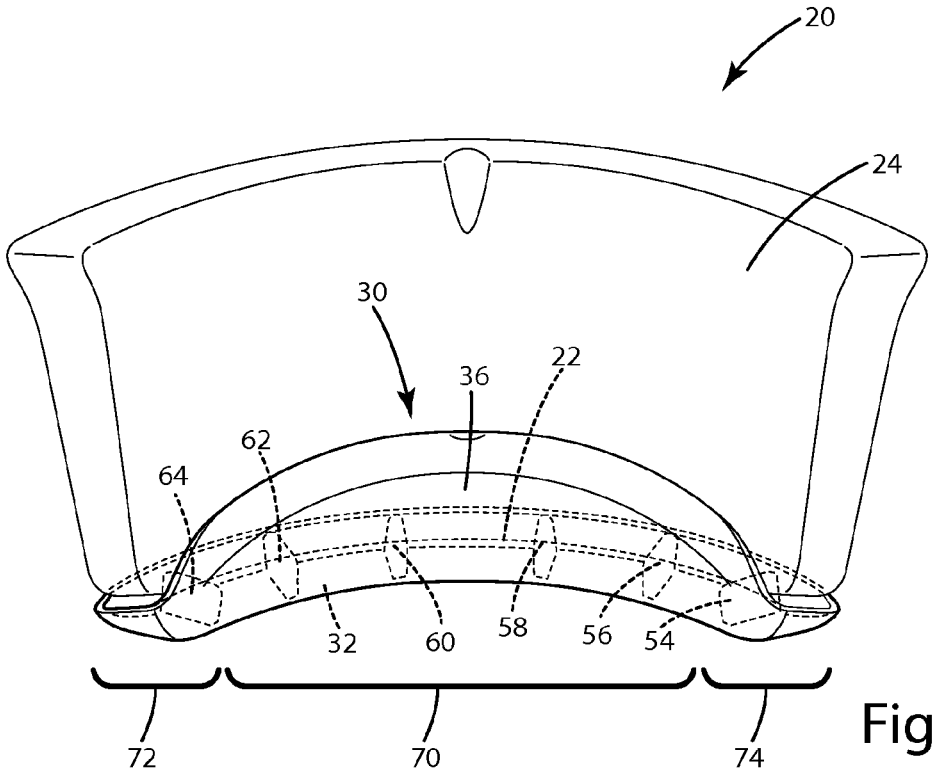
FIG. 3 is a front view of a neck roll and an occipital portion of a liner of the helmet.
Figure 4:
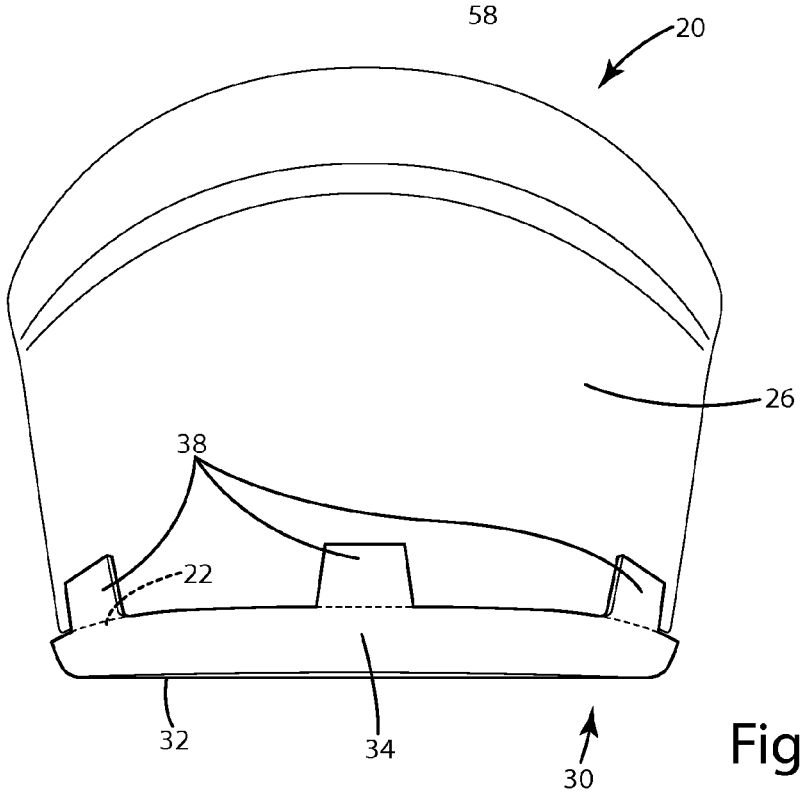
FIG. 4 is a rear view of the neck roll and the occipital portion of a liner of the helmet.
Figure 5:
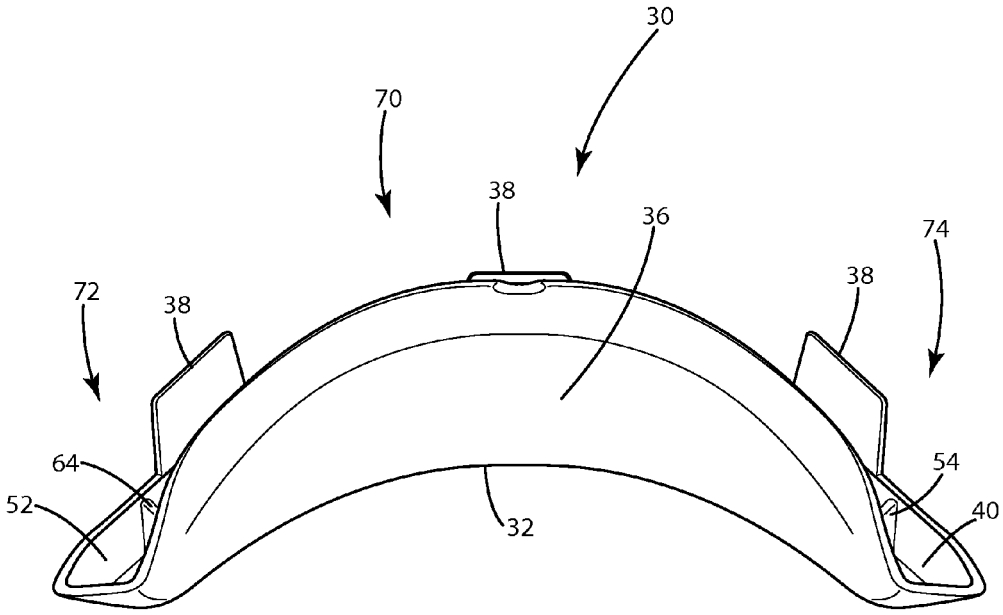
FIG. 5 is a front perspective view of the neck roll.

As shown in FIGS. 3-5, the occipital portion 20 can include a lower rim 22, an interior surface 24 and an exterior surface 26. The crown portion 16 and the occipital portion 20 can define an interior of the liner that can be adapted to be positioned adjacent a wearer's head. The liner 14 can be constructed from any of a variety of materials, including expanded polypropylene, expanded polyethylene, vinyl nitrile, polyurethane, polystyrene and combinations of the foregoing. The liner can be manufactured using any of a variety of suitable processes. Optionally, although shown as a generally solid and/or rigid liner, the liner and its components can include other impact absorbing structures, such as air filled bladders, pucks, separate foam blocks, a variety of other liner structures, and combinations of the foregoing.

The liner 14 can be joined with the interior surface 15 of the outer shell 12 with any suitable fasteners, including snaps, buttons, glue, adhesives, tacks, staples, screws, rivets, hook-and-loop fasteners and/or combinations of the foregoing. Optionally, additional comfort liners or padding also can be secured between the liner 14 and the outer shell 12 or on the interior of the liner 14 as desired. The comfort liners can be secured to the inner surface of the outer shell 12 and/or portions of the liner 14 by suitable fasteners, including snaps, buttons, glue, adhesives, tacks, staples, screws, rivets, hook-and-loop fasteners and/or combinations of the foregoing.

As shown in FIGS. 2-4, the neck roll 30 can be positioned adjacent and/or engage the lower rim 22 to absorb an impact between the helmet 10 and features of the wearer's anatomy. The neck roll 30 can include a central region 70 and opposing outer regions 72, 74. The neck roll 30 can include a base 32, an exterior wall 34, an interior wall 36 and one or more support members 54, 56, 58, 60, 62, 64. The exterior wall 34 can extend generally upward from a rearward edge of the base 32 and the interior wall 36 can extend generally upward from a forward edge of the base 32.

The support members 54, 56, 58, 60, 62, 64 can extend generally upward from the base 32 toward the lower rim 22 of the occipital portion 20. The support members 54, 56, 58, 60, 62, 64 can extend partially or the entire distance between the base 32 and the lower rim 22, and further, can engage the lower rim 22 if desired. Optionally, at least one support member 54, 56, 58, 60, 62, 64 can extend the entire distance between the base 32 and the lower rim 22, while at least one other support member 54, 56, 58, 60, 62, 64 can extend only a partial distance between the base 32 and the lower rim 22, in which case there can be a gap between the lower rim 22 and the support members 54, 56, 58, 60, 62, 64 and/or a gap between the support members 54, 56, 58, 60, 62, 64 and the base 32. For example, in the embodiment shown in FIG. 3, support members 56, 58, 60, 62 contact and engage the lower rim 22, while support members 54, 64 are spaced from the lower rim 22. The support members 54, 56, 58, 60, 62, 64 can also extend part of or the entire distance between the exterior wall 34 and the interior wall 36.

The base 32 can be positioned at a preselected distance from the lower rim 22 to provide the neck roll 30 with desired impact absorption characteristics. Optionally, the preselected distance can be varied to adjust the impact absorption characteristics. For example, the preselected distance may optionally be between about 0.1 and 1 inch, further optionally between about 0.25 and 0.5 inches and even further optionally about 0.375 inches.

The interior wall 36 can extend the same distance as the preselected distance between the base 32 and the lower rim 22, or optionally, the interior wall 36 can extend a lesser or a greater distance than the preselected distance. As shown in the embodiment in FIG. 3, the interior wall 36 can extend upward from the base 32, past the support members 54, 56, 58, 60, 62, 64 and past the lower rim 22. In this embodiment, the interior wall 36 can be adapted for placement adjacent the interior surface 24 of the occipital portion 20. The exterior wall 34 also can extend the same distance as the preselected distance between the base 32 and the lower rim 22, or optionally, the exterior wall 34 can extend a greater distance than the preselected distance. As shown in the embodiment in FIG. 4, the exterior wall 34 can extend upwards from the base 32, past the support members 54, 56, 58, 60, 62, 64 and past the lower rim 22. In this embodiment, the exterior wall 34 can be adapted for placement adjacent the exterior surface 26 of the occipital portion 20. Optionally, the interior wall 36 and/or the exterior wall 34 may be contoured to substantially match the respective contours of the interior surface 24 and/or the exterior surface 36.

In the embodiment shown in FIGS. 3-4, the exterior wall 34 and/or interior wall 36 can include respective interior and/or exterior attachment portions that releasably or non-releasably secure the neck roll 30 to the liner 14 and/or shell 12. For example, the exterior wall 34 and/or the interior wall 36 can be joined with the exterior surface 26 and/or the interior surface 24 of the occipital portion 20 using any suitable fasteners, including snaps, buttons, glue, adhesives, tacks, staples, screws, rivets, hook-and-loop fasteners and/or combinations of the foregoing.

As shown in the embodiment in FIG. 4, the exterior wall 34 can include spaced apart flaps 38 that engage the exterior surface 26 of the occipital portion 20 with suitable fasteners, such as those mentioned above. Of course, if desired, these flaps can be joined to form a single unitary flap if desired. As another option, the flaps can be about and fasteners can be joined with the base 32 and/or support members 54, 56, 58, 60, 62, 64, as well as with the lower rim 22. As shown, the flaps 38 are located between the liner 20 and the shell 12 when the neck roll 30 is installed. Optionally, the flaps can be joined directly to the shell 12 as well with suitable fasteners.

With reference to FIGS. 1 and 4, when installed in the helmet 10, the neck roll 20 can be oriented so that the exterior wall 34 extends between, and/or is sandwiched between, the outer shell 12 and the liner 14. As another option, the exterior wall 34 can extend outside of the outer shell 12 and attach, for example, to the exterior of the helmet 10 with suitable fasteners. Further optionally, the exterior wall and/or flaps can attach directly to the lower rim 17 of the outer shell 12 with suitable fasteners.

The base 32, exterior wall 34, interior wall 36 and support members 54, 56, 58, 60, 62, 64 can define one or more impact absorption compartments 40, 42, 44, 46, 48, 50, 52 that can compress and/or deform to absorb impact between the helmet 10 and the wearer. The impact absorption compartments 40, 42, 44, 46, 48, 50, 52 can compress and/or deform because one or more of the elements defining and/or contained within the impact absorption compartments 40, 42, 44, 46, 48, 50, 52 can compress and/or deform. For example, the support members 54, 56, 58, 60, 62, 64 can be deformable and/or compressible such that when the base 32 is impacted, the base 32 transmits the force to the support members 54, 56, 58, 60, 62, 64, which deform and/or compress to absorb the impact. In this manner, the impact absorption compartments 40, 42, 44, 46, 48, 50, 52 can also compress and/or deform to absorb the forces of an impact. Further, the base 32, exterior wall 34 and/or the interior wall 36 can be deformable and/or compressible to further absorb impact forces transmitted to the base 32.

The impact absorption characteristics of each impact absorption compartment 40, 42, 44, 46, 48, 50, 52 can vary from one another by controlling the deformation of each impact absorption compartment 40, 42, 44, 46, 48, 50, 52. The collective impact absorption characteristics of all of the impact absorption compartments 40, 42, 44, 46, 48, 50, 52 can also be varied. For example, the width of each impact absorption compartment can vary. The width of each impact absorption compartment 40, 42, 44, 46, 48, 50, 52 is defined by the distance between the corresponding adjacent support members 54, 56, 58, 60, 62, 64 that define the impact absorption compartment 40, 42, 44, 46, 48, 50, 52. Optionally, the distance between support member 58 and support member 60 may be between about 0.25 and 3.0 inches, further optionally between about 1.5 and 2.5 inches, and even further optionally about 2.0 inches. Further, the distance between support member 56 and support member 58, and the distance between support member 60 and 62, may be between about 0.25 to 2.75 inches, further optionally between about 0.5 and 2.0 inches, and even further optionally about 1.5 inches. The distance between support member 56 and support member 58 may be substantially the same as or different than the distance between support member 60 and support member 62. Optionally, the distance between support member 54 and support member 56 and the distance between support member 62 and support member 64 may be between about 0.25 and 2.25 inches, further optionally between about 0.75 and 1.75 inches and even further optionally about 1.25 inches. Further, the distance between support member 54 and support member 56 may be substantially the same as or different than the distance between support member 62 and support member 64.

Figure 6:
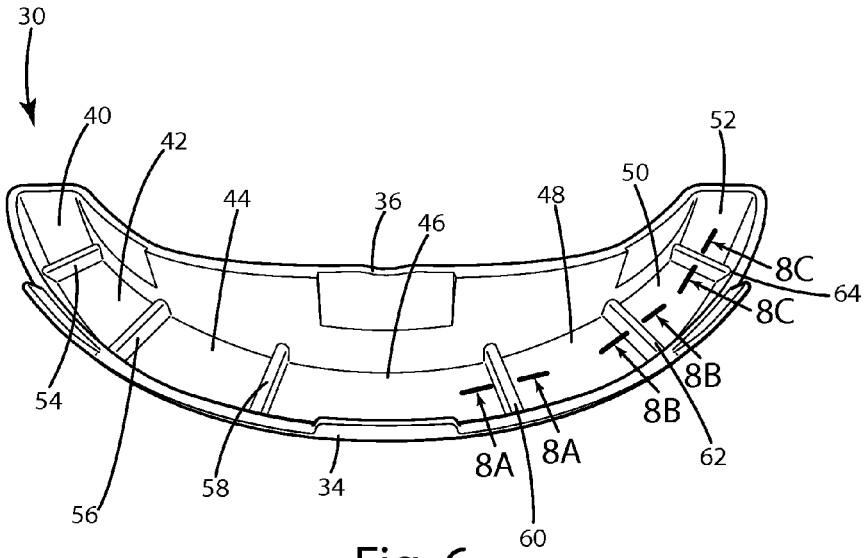
FIG. 6 is a rear perspective view of the neck roll.
Figure 7:
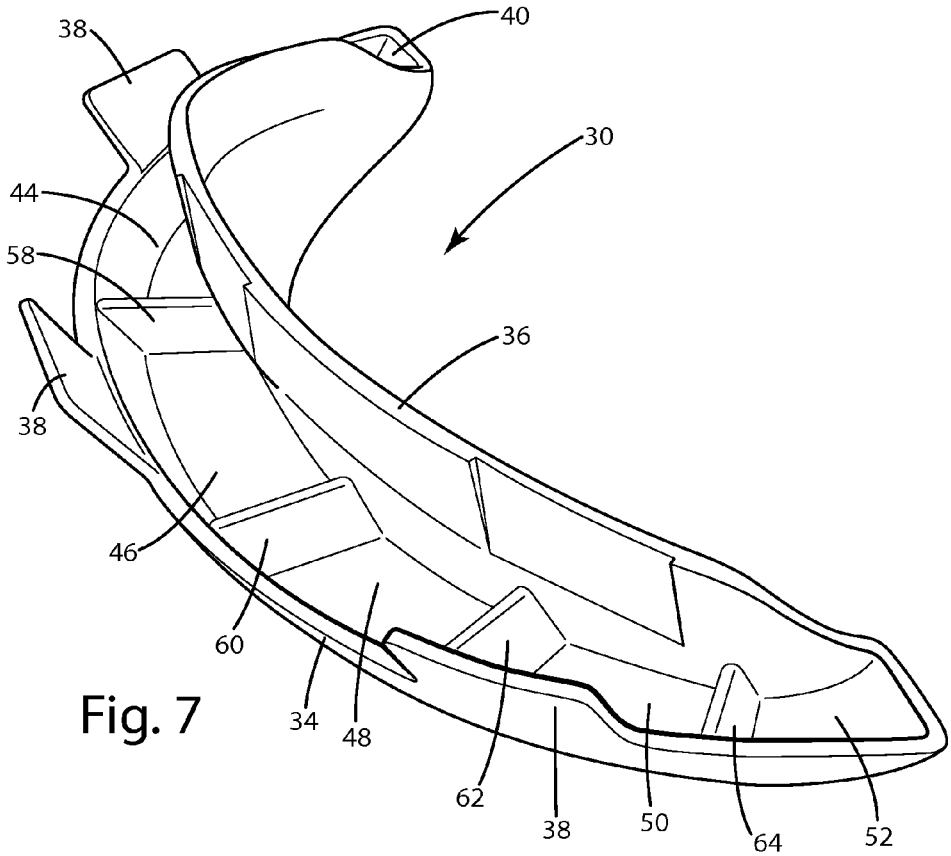
FIG. 7 is a side perspective view of the neck roll.

In the embodiment shown in FIG. 6, the distance between support member 58 and support member 60 is less than the distance between support member 56 and support member 58. This can create different impact absorption and deformation characteristics between impact absorption compartment 44 and impact absorption compartment 46. The width of the impact absorption compartments 40, 42, 44, 46, 48, 50, 52 can decrease when moving from the central region 70 to the outer regions 72, 74 to provide desired impact absorption characteristics.

In other words, in the embodiment shown in FIG. 6, the width of impact absorption compartment 46 can be greater than the width of impact absorption compartment 44, which can be greater than the width of impact absorption compartment 42, which can be greater than the width of impact absorption compartment 40. Varying the spacing of the support members 54, 56, 58, 60, 62, 64 varies the deformation of the support members in response to a force. If the support members are close together, the same force may not deform the support members as much when compared to a configuration in which the support members are farther apart. In this manner, the impact absorption compartments 40, 42, 44, 46, 48, 50, 52 are generally more rigid if the support members 54, 56, 58, 60, 62, 64 are positioned closer together. In a more rigid configuration, the neck roll 30 can transmit slightly more force from the helmet 10 to the wearer and absorbs less of the force. In a less rigid configuration, that is, the support members 54, 56, 58, 60, 62, 64 are spaced farther apart, the neck roll 30 can transmit slightly less of the force from the helmet 10 to the wearer and instead absorbs more of the force.

Optionally, one or more of the distances between adjacent support members 54, 56, 58, 60, 62, 64 can be varied from the illustrated embodiment of the neck roll 30 to create impact absorption and deformation characteristics that differ from the illustrated embodiment. If the attachment of the neck roll to the helmet is releasable, different embodiments of the neck roll 30 with different impact absorption characteristics (described above and below) can be interchanged with the helmet 10 to provide a wearer with a precisely-designed level of impact absorption.

The impact absorption characteristics of each impact absorption compartment 40, 42, 44, 46, 48, 50, 52 can also be varied by varying the angle of the support members 54, 56, 58, 60, 62, 64. Each support member 54, 56, 58, 60, 62, 64 is positioned at an angle relative to the base 32. As shown in the embodiment illustrated in FIGS. 6 and 8A-8C, support member 60 is positioned at angle A, support member 62 is positioned at angle B, and support member 64 is positioned at angle C. In the illustrated embodiment, the angles A, B, C each have different values. Optionally, angle A may be between about 65° and 90°, further optionally between about 75° and 90°, and even further optionally about 85°. Optionally, angle B may be between about 60° and 90°, further optionally between about 70° and 85°, and even further optionally about 80°. Optionally, angle C may be between about 35° and 65°, further optionally between about 45° and 55°, and even further optionally about 50°. Optionally, the angles of support member 54, support member 56 and support member 58 may be substantially supplementary to respective angles A, B, C (i.e. mirror images), or further optionally, may have other values.

Varying the angle of the support members 54, 56, 58, 60, 62, 64 can create different impact absorption and deformation characteristics between different impact absorption compartments 40, 42, 44, 46, 48, 50, 52. A support member 54, 56, 58, 60, 62, 64 with a lesser angle will generally deform more easily than a support member with a greater angle. In this manner, the angles may be varied to vary the rigidity of the impact absorption compartments 40, 42, 44, 46, 48, 50, 52, and the rigidity of the neck roll 30, as described above in connection with varying the width of the impact absorption compartments.

The angle of the support members 54, 56, 58, 60, 62, 64 can decrease when moving from the central region 70 to the outer regions 72, 74 to provide desired impact absorption characteristics. In other words, in the embodiment shown in FIGS. 6 and 8A-8C, the angle A of support member 60 can be greater than the angle B of support member 62, which can be greater than the angle C of support member 64. Optionally, one or more of the angles of the support members 54, 56, 58, 60, 62, 64 can be varied from the illustrated embodiment of the neck roll 30 to create impact absorption and deformation characteristics that differ from the illustrated embodiment.

Figure 8A:
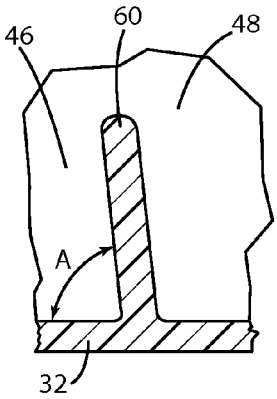
FIG. 8A is a sectional view of a support member along the line 8A-8A in FIG. 6.
Figure 8B:
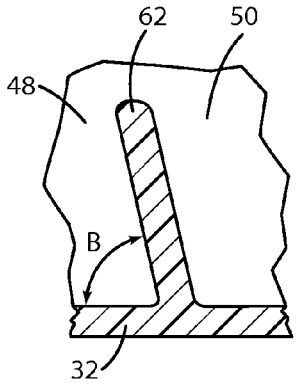
FIG. 8B is a sectional view of a support member along the line 8B-8B in FIG. 6.
Figure 8C:
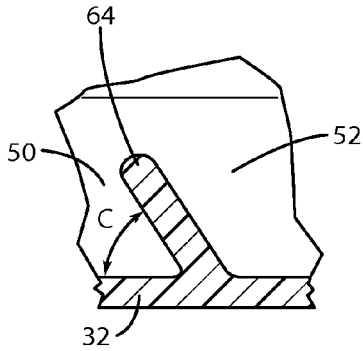
FIG. 8C is a sectional view of a support member along the line 8C-8C in FIG. 6.

The impact absorption characteristics of the impact absorption compartments 40, 42, 44, 46, 48, 50, 52 can also be varied by varying the length of the support members 54, 56, 58, 60, 62, 64. Each support member 54, 56, 58, 60, 62, 64 has a length extending from base 32, perhaps best shown in the embodiment in FIGS. 6 and 8A-8C. As shown in FIGS. 8A-8C, support members 60, 62 can have about the same length, and support member 64 can have a shorter length. The length of support member 56, support member 58, support member 60 and support member 62 may be between about 0.1 and 1.0 inches, further optionally between about 0.25 and 0.75 inches, and even further optionally about 0.4375 inches. The length of one or more of support member 56, support member 58, support member 60 and support member 62 may be substantially the same as or different than another of these support members. The length of support member 54 and support member 64 may be between about 0.1 and 1.0 inches, further between about 0.2 and 0.5 inches, and even further about 0.3125 inches. The length of support member 54 may be substantially the same as or different than the length of support member 64.

Varying the length of the support members 54, 56, 58, 60, 62, 64 can create different impact absorption and deformation characteristics between different impact absorption compartments 40, 42, 44, 46, 48, 50, 52. A support member 54, 56, 58, 60, 62, 64 with a greater length will generally deform more easily than a support member with a lesser length. In this manner, the lengths of the support members 54, 56, 58, 60, 62, 64 may be varied to vary the rigidity of the impact absorption compartments 40, 42, 44, 46, 48, 50, 52, and the rigidity of the neck roll 30, as described above in connection with varying the width of the impact absorption compartments.

The length of the support members 54, 56, 58, 60, 62, 64 can decrease when moving from the central region 70 to the outer regions 72, 74 to provide desired impact absorption characteristics. In other words, the embodiment shown in FIGS. 6 and 8A-8C can be modified such that the length of support member 60 can be greater than the length of support member 62, which can be greater than the length of support member 64. Optionally, one or more of the lengths of the support members 54, 56, 58, 60, 62, 64 can be varied from the illustrated embodiment of the neck roll 30 to create impact absorption and deformation characteristics that differ from the illustrated embodiment.

The impact absorption characteristics of the impact absorption compartments 40, 42, 44, 46, 48, 50, 52 can also be varied by varying the thickness of the support members 54, 56, 58, 60, 62, 64. Each support member 54, 56, 58, 60, 62, 64 has a thickness, perhaps best shown in the embodiment in FIGS. 6 and 8A-8C. As shown in FIGS. 8A-8C, each of the support members 60, 62, 64 can have about the same thickness. Optionally, the thickness of one or more support members 54, 56, 58, 60, 62, 64 can be different than the thickness of another one or more of the support members 54, 56, 58, 60, 62, 64. Further optionally, the thicknesses can vary when moving from the central region 70 to the outer regions 72, 74. For example, the embodiment shown in FIGS. 6 and 8A-8C can be modified such that the thickness of support member 60 can be greater than the thickness of support member 62, which can be greater than the thickness of support member 64. In another example, the embodiment shown in FIGS. 6 and 8A-8C can be modified such that the thickness of support member 60 can be less than the thickness of support member 62, which can be less than the thickness of support member 64.

Varying the thickness of the support members 54, 56, 58, 60, 62, 64 can create different impact absorption and deformation characteristics between different impact absorption compartments 40, 42, 44, 46, 48, 50, 52. A support member 54, 56, 58, 60, 62, 64 with a lesser thickness will generally deform more easily than a support member with a greater thickness. In this manner, the thicknesses of the support members 54, 56, 58, 60, 62, 64 may be varied to vary the rigidity of the impact absorption compartments 40, 42, 44, 46, 48, 50, 52, and the rigidity of the neck roll 30, as described above in connection with varying the width of the impact absorption compartments. Further optionally, one or more of the thicknesses of the support members 54, 56, 58, 60, 62, 64 can be varied from the illustrated embodiment of the neck roll 30 to create impact absorption and deformation characteristics that differ from the illustrated embodiment.

The impact absorption characteristics of the impact absorption compartments 40, 42, 44, 46, 48, 50, 52 can also be varied by varying the volume of the impact absorption compartments 40, 42, 44, 46, 48, 50, 52. Each impact absorption compartment 40, 42, 44, 46, 48, 50, 52 has a volume generally bounded by the base 32, two adjacent support members 54, 56, 58, 60, 62, 64, the exterior wall 34, the interior wall 36 and the lower rim 22 of the liner 14. Each impact absorption compartment can be partially bounded or partially defined by only some of these elements. For example, the impact absorption compartments 40, 42, 44, 46, 48, 50, 52 can be capped, such that each impact absorption compartment 40, 42, 44, 46, 48, 50, 52 is air-tight and the cap, rather than the lower rim 22, combines with the other elements to define the volume of the impact absorption compartments 40, 42, 44, 46, 48, 50, 52.

As shown in the embodiment in FIG. 6, each of the impact absorption compartments 40, 42, 44, 46, 48, 50, 52 can have a different volume. Optionally, the volumes of the impact absorption compartments 40, 42, 44, 46, 48, 50, 52 can decrease when moving from the central region 70 to the outer regions 72, 74. Perhaps as best shown in the embodiment illustrated in FIG. 6, impact absorption compartment 46 can have a greater volume than impact absorption compartment 48, which can have a greater volume than impact absorption compartment 50, which can have a greater volume than impact absorption compartment 52.

Varying the volume of the impact absorption compartments 40, 42, 44, 46, 48, 50, 52 can create different impact absorption and deformation characteristics between different impact absorption compartments 40, 42, 44, 46, 48, 50, 52. An impact absorption compartment 40, 42, 44, 46, 48, 50, 52 with a greater volume will generally deform more easily than an impact absorption compartment with a lesser volume. In this manner, the volumes of the impact absorption compartments 40, 42, 44, 46, 48, 50, 52 may be varied to vary the rigidity of the individual impact absorption compartments, and the rigidity of the neck roll 30, as described above in connection with varying the width of the impact absorption compartments. Further optionally, one or more of the volumes of the impact absorption compartments 40, 42, 44, 46, 48, 50, 52 can be varied from the illustrated embodiment of the neck roll 30 to create impact absorption and deformation characteristics that differ from the illustrated embodiment.

Optionally, one or more of the impact absorption compartments 40, 42, 44, 46, 48, 50, 52 can be partially or completely filled with a material that affects the impact absorption and deformation characteristics of the impact absorption compartments 40, 42, 44, 46, 48, 50, 52. For example, the material may be elastic compressible or more rigid, depending on the desired characteristics. The material may be expanded polypropylene, expanded polyethylene, vinyl nitrile, polyurethane, polystyrene, foam, rubber, plastic, composite, or any other suitable material.

The neck roll 30 can be constructed from any of a variety of suitable elastomeric materials, including but not limited to, flexible plastics, elastomers, thermoplastic elastomers and thermoplastic rubbers. The neck roll 30 can be constructed using a single material with uniform performance characteristics and physical properties. Of course, different elements of the neck roll can be constructed using different materials, or the same material with different characteristics, to provide the desired impact absorption characteristics. For example, the base 32, exterior wall 34 and interior wall 36 can be constructed from one material, and the support members 54, 56, 58, 60, 62, 64 can be constructed from another material. Optionally, the different materials may have different densities to provide different compressibility and physical characteristics between the materials. The neck roll 30 can be manufactured using any of a variety of suitable processes, including single shot injection molding, multiple shot injection molding and thermoforming.

The above descriptions are those of the preferred embodiments of the invention. Various alterations and changes can be made without departing from the spirit and broader aspects of the invention as defined in the appended claims, which are to be interpreted in accordance with the principles of patent law including the doctrine of equivalents. Any references to claim elements in the singular, for example, using the articles "a," "an," "the," or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The embodiments of the invention in which an exclusive property or privilege is claimed are defined as follows:

1. A helmet comprising: a hard outer shell defining an interior and including an interior surface, the interior surface adapted to face toward a head of a wearer; a liner located adjacent the interior surface of the outer shell, the liner including a crown portion and an occipital portion, the crown portion adapted to be positioned adjacent a crown of the wearer's head, the occipital portion adapted to be positioned adjacent an occipital region of the wearer's head, the occipital portion including a lower rim; and a neck roll positioned adjacent the lower rim, the neck roll including a base separated from the lower rim by a preselected distance, the neck roll including a plurality of support members extending between the base and the lower rim, the plurality of support members separating the neck roll into a plurality of impact absorption compartments, wherein the neck roll includes an interior wall and an exterior wall contoured to follow a rounded curvature of the lower rim, the interior wall and exterior wall bounding at least a portion of the plurality of impact absorbing compartments, wherein the base is contoured to follow the rounded curvature of the lower rim, wherein each of the plurality of impact absorption compartments is defined by a width between first and second support members of the plurality of impact absorption compartments, and with at least one of the plurality of absorption compartments having a different width from another of the plurality of impact absorption compartments, and wherein the neck roll is configured so that when the head of the wearer is forced sideways or rearward, the neck roll absorbs an impact between the helmet and at least one of the wearer's back, trapezius, shoulder and neck, wherein the impact causes at least one of the plurality of impact absorption compartments to compress.

2. The helmet of claim 1 wherein the support members are deformable, whereby the impact to the neck roll causes at least one of the plurality of support members to deform, thereby compressing so that the at least one of the plurality of impact absorption compartments absorbs the impact.

3. The helmet of claim 2 wherein the support members are joined with and extend upward from the base toward the lower rim of the liner.

4. The helmet of claim 1 wherein the interior wall and the exterior wall extend upwardly adjacent the liner so that the occipital portion of the liner is disposed between the interior wall and the exterior wall.

5. The helmet of claim 4 wherein at least one of the interior wall and the exterior wall is secured directly to the liner.

6. The helmet of claim 5 wherein the interior wall extends beyond the plurality of support members, and is adapted for placement adjacent an interior of the liner.

7. The helmet of claim 6 wherein a first set of adjacent support members define a first distance, wherein a second set of adjacent support members define a second distance, wherein the first distance is one of greater than and less than the second distance.

8. The helmet of claim 6 wherein each support member defines an angle relative to the base, wherein the angle of at least one of the support members relative to the base is one of greater than and less than the angle of another of the support members relative to the base.

9. The helmet of claim 8 wherein the neck roll has a central region and opposing outer regions, wherein the angle of a support member relative to the base positioned in the central region is greater than the angle of a support member relative to the base positioned in either of the opposing outer regions.

10. A neck roll adapted to absorb an impact between a helmet and a wearer comprising: a base adapted to be spaced from a liner of the helmet; a plurality of support members extend from the base, each of the plurality of support members being deformable, at least one of the plurality of support members adapted to engage the liner of the helmet; a plurality of impact absorption compartments at least partially defined by the base and the plurality of support members, the impact absorption compartments being deformable; and at least one of an interior attachment portion and an exterior attachment portion, the at least one of an interior attachment portion and an exterior attachment portion adapted to secure the neck roll relative to the liner of the helmet, wherein the neck roll is configured for attachment to a helmet so that when the head of the wearer is forced sideways or rearward, the neck roll absorbs an impact between the helmet and at least one of the wearer's back, trapezius, shoulder and neck, wherein each of the plurality of impact absorption compartments is defined by a width between first and second support members of the plurality of impact absorption compartments with at least one of the plurality of absorption compartments having a different width from another of the plurality of impact absorption compartments; and whereby the plurality of support members and the plurality of impact absorption compartments deform to absorb at least a portion of the impact between the helmet and the wearer.

11. The neck roll of claim 10 wherein each of the plurality of support members is positioned at an angle relative to the base, wherein the angle of at least one of the support members relative to the base is one of greater than and less than the angle of another one of the support members relative to the base.

12. The neck roll of claim 11 wherein the neck roll includes an interior wall and an exterior wall contoured to follow a rounded contour of a lower rim of the neck roll, the interior wall and exterior wall bounding at least a portion of the plurality of impact absorbing compartments.

13. A neck roll adapted to absorb an impact between a helmet and a wearer comprising:

a base adapted to be spaced from a liner of the helmet;

a plurality of support members extend from the base, each of the plurality of support members being deformable, at least one of the plurality of support members adapted to engage the liner of the helmet;

a plurality of impact absorption compartments at least partially defined by the base and the plurality of support members, the impact absorption compartments being deformable; and at least one of an interior attachment portion and an exterior attachment portion, the at least one of an interior attachment portion and an exterior attachment portion adapted to secure the neck roll relative to the liner of the helmet, whereby the plurality of support members and the plurality of impact absorption compartments deform to absorb at least a portion of the impact between the helmet and the wearer;

wherein the plurality of impact absorption compartments each have a width defined by two adjacent support members, wherein the width of at least one impact absorption compartment is one of greater than and less than the width of another one of the impact absorption compartments, wherein the neck roll includes a central region and opposing outer regions, wherein the width of an impact absorption compartment positioned in the central region is greater than the width of an impact absorption compartment positioned in either of the opposing outer regions.

14. The neck roll of claim 10 wherein the plurality of support members each have a length, wherein the length of at least one support member is one of greater than and less than the length of another one of the support members.

15. The neck roll of claim 14 wherein the neck roll includes a central region and opposing outer regions, wherein the length of a support member positioned in the central region is greater than the length of a support member positioned in either of the opposing outer regions.

16. The neck roll of claim 10 wherein the interior attachment portion and the exterior attachment portion extend upwardly adjacent the liner so that the liner is disposed between the interior attachment portion and the exterior attachment portion.

17. The neck roll of claim 10 wherein the at least one of an interior attachment portion and an exterior attachment portion is secured to the liner of the helmet to join the neck roll to the liner.

18. The neck roll of claim 17 wherein the base includes a forward edge and a rearward edge, the neck roll including an interior wall extending from the forward edge and an exterior wall extending from the rearward edge, wherein each of the plurality of support members extend between the interior wall and the exterior wall.

19. The neck roll of claim 18 wherein at least one of the interior wall and the exterior wall extends above at least one of the plurality of support members.

20. The neck roll of claim 10 including an exterior attachment portion, the exterior attachment portion including a plurality of spaced-apart flaps adapted to engage an exterior surface of the liner of the helmet.

21. The neck roll of claim 20 including an interior attachment portion, the interior attachment portion including an interior wall adapted to engage an interior surface of the liner of the helmet.

22. A helmet comprising:

a hard outer shell, the outer shell having an interior surface;

a liner disposed adjacent the interior surface of the outer shell, the liner including a lower rim;

a neck roll operably coupled to the lower rim, the neck roll including a base separated from the lower rim by a preselected distance, the neck roll including independent deformable impact absorption compartments positioned between the base and the lower rim, the plurality of impact absorption compartments each having a volume, at least one of the plurality of volumes being one of greater than and less than another one of the plurality of volumes, wherein the neck roll is adapted to absorb an impact between the helmet and a portion of a wearer's body, wherein the neck roll has a central region and opposing outer regions, wherein the volume of an impact absorption compartment positioned in the central region is greater than the volume of an impact absorption compartment positioned in either of the opposing outer regions.

23. The helmet of claim 22 wherein the neck roll includes an interior wall and an exterior wall, wherein the volume of each impact absorption compartment is bounded by two adjacent support members, the interior wall, the exterior wall and the lower rim of the liner.

24. The helmet of claim 22 wherein the neck roll includes an interior wall spaced from an exterior wall, wherein the interior wall and the exterior wall extend upwardly adjacent the liner so that the liner is disposed between the interior wall and the exterior wall.

* * * * *